US009017138B2

(12) United States Patent
Chen et al.

(10) Patent No.: US 9,017,138 B2
(45) Date of Patent: Apr. 28, 2015

(54) RETAINING RING MONITORING AND CONTROL OF PRESSURE

(71) Applicant: Applied Materials, Inc., Santa Clara, CA (US)

(72) Inventors: Hung Chih Chen, Sunnyvale, CA (US); Thomas H. Osterheld, Mountain View, CA (US); Charles C. Garretson, Sunnyvale, CA (US); Jason Garcheung Fung, Sunnyvale, CA (US)

(73) Assignee: Applied Materials, Inc., Santa Clara, CA (US)

( * ) Notice: Subject to any disclaimer, the term of this patent is extended or adjusted under 35 U.S.C. 154(b) by 141 days.

(21) Appl. No.: 13/749,554

(22) Filed: Jan. 24, 2013

(65) Prior Publication Data

US 2013/0203321 A1 Aug. 8, 2013

Related U.S. Application Data

(60) Provisional application No. 61/590,724, filed on Jan. 25, 2012.

(51) Int. Cl.

| | |
|---|---|
| ***B24B 49/02*** | (2006.01) |
| ***B24B 37/005*** | (2012.01) |
| ***B24B 37/32*** | (2012.01) |
| ***B24B 37/34*** | (2012.01) |

(52) U.S. Cl.

CPC ..... *B24B 37/005* (2013.01); *B24B 37/32* (2013.01); *B24B 37/345* (2013.01)

(58) Field of Classification Search

USPC ..... 451/5, 6, 9, 10, 11, 41, 285, 287, 288, 451/339

See application file for complete search history.

(56) References Cited

U.S. PATENT DOCUMENTS

| | | | | |
|---|---|---|---|---|
| 5,738,574 | A * | 4/1998 | Tolles et al. | 451/288 |
| 6,390,908 | B1 | 5/2002 | Chen et al. | |
| 7,044,832 | B2 * | 5/2006 | Yilmaz et al. | 451/5 |
| 7,699,688 | B2 | 4/2010 | Zuniga et al. | |
| 2012/0021671 | A1 * | 1/2012 | McReynolds et al. | 451/6 |

FOREIGN PATENT DOCUMENTS

| | | |
|---|---|---|
| EP | 1713068 | 10/2006 |
| KR | 10-2002-0010881 | 2/2002 |
| KR | 10-2003-0010621 | 2/2003 |
| KR | 10-2005-0067147 | 6/2005 |
| KR | 10-0615696 | 8/2006 |
| KR | 10-2011-0045082 | 5/2011 |
| WO | WO 2006/049269 | 5/2006 |

OTHER PUBLICATIONS

International Search Report and Written Opinion in International Application No. PCT/US2013/023026, mailed May 30, 2013, 13 pages.

* cited by examiner

*Primary Examiner* — Eileen P. Morgan
(74) *Attorney, Agent, or Firm* — Fish & Richardson P.C.

(57) ABSTRACT

A load cup apparatus for transferring a substrate in a processing system includes a pedestal assembly having a substrate support, an actuator, and a controller. The actuator is configured to move the pedestal assembly into a loading position in contact with a retaining ring of a carrier head and to generate a retaining ring thickness signal based on a distance travelled by the pedestal assembly. The controller is configured to receive the retaining ring thickness signal from the actuator.

18 Claims, 2 Drawing Sheets

RETAINING RING MONITORING AND CONTROL OF PRESSURE

CROSS-REFERENCE TO RELATED APPLICATIONS

This application claims priority to U.S. Provisional Application Ser. No. 61/590,724, field Jan. 25, 2012, the entire disclosure of which is incorporated by reference.

TECHNICAL FIELD

This disclosure relates to monitoring the thickness of a retaining ring, and to using a measured thickness of the retaining ring to control pressure applied during polishing.

BACKGROUND

Chemical mechanical polishing (CMP) is one of many processes used in the fabrication of high density integrated circuits. Chemical mechanical polishing is generally performed by moving a substrate against a polishing material in the presence of a polishing fluid. In many polishing applications, the polishing fluid contains an abrasive slurry to assist in the planarization of the feature side of the substrate that is pressed against the polishing material during processing.

The substrate is generally retained during polishing operations by a polishing head. Conventional polishing heads include a retaining ring bounding a substrate retaining pocket. The substrate may be held in the substrate retaining pocket by stiction to a flexible membrane. The retaining ring prevents the substrate from slipping out from under the polishing head during polishing.

During polishing, the retaining ring is typically pressed against the polishing pad. A pressurizable chamber in the carrier head can control the vertical position of the retaining ring. The retaining ring is typically formed of a wearable material, and as polishing progresses, the bottom surface of the retaining ring is worn away. Consequently, the thickness of the retaining ring can change over the course of processing multiple substrates.

Most CMP systems employ a vertically actuatable transfer mechanism, commonly known as a load cup, to transfer substrates between the polishing head and a blade of a robot. The retaining ring and the load cup can include alignment features so that, as the load cup is raised toward the carrier head, the load cup engages the retaining ring and the substrate is aligned with the pocket in the carrier head.

SUMMARY

The thickness of the retaining ring can impact the removal profile of the substrate being polished. Without being limited to any particular theory, when the retaining ring is pressed against the polishing pad, assuming a consistent pressure is applied by the chamber in the carrier head, the amount of compression of the polishing pad depends on the retaining ring thickness. Since the retaining ring wears over time, different substrates will undergo different removal profiles, leading to wafer-to-wafer non-uniformity (WTWNU). By monitoring the thickness of the retaining ring, the pressure applied by the carrier head can be adjusted to compensate and improve the WTWNU. The vertical actuation of the load cup can be used to measure the thickness of the retaining ring.

In one aspect, a load cup apparatus for transferring a substrate in a processing system includes a pedestal assembly having a substrate support, an actuator, and a controller. The actuator is configured to move the pedestal assembly into a loading position in contact with a retaining ring of a carrier head and to generate a retaining ring thickness signal based on a distance travelled by the pedestal assembly. The controller is configured to receive the retaining ring thickness signal from the actuator.

Implementations may include one or more of the following features. The pedestal assembly may include a body having a top surface and an inwardly projecting ledge to support the substrate, and the ledge may have an upper surface below the top surface. The pedestal assembly may include a lip projecting above the top surface, and the lip may have a sloped inner wall. The pedestal assembly may be configured such that in the loading position the top surface of the body contacts a bottom surface of the retaining ring. The lip may have a horizontal surface radially outward of the sloped inner wall. The controller may be configured to compare the retaining ring thickness signal to a threshold value and to determine whether to generate an alert based on the comparison. The controller may be configured to adjust a pressure of at least one chamber in the carrier head based on the retaining ring thickness signal. The controller may be configured to determine a retaining ring thickness value from the retaining ring thickness signal. The controller may be configured to store a look-up table relating signal values to thickness values. The at least one chamber include be a chamber that adjusts a vertical position of the retaining ring.

In another aspect, a polishing apparatus includes a polishing station, a transfer station, a carrier head movable between the polishing station and the transfer station, and a controller. The transfer station includes a pedestal assembly and an actuator. The pedestal assembly has a substrate support. The actuator is configured to move the pedestal assembly into a loading position, and is configured to generate a signal based on a distance traveled by the pedestal assembly. The carrier head includes a retaining ring and a plurality of independently pressurizable chambers, and in the loading position the pedestal assembly contacts the retaining ring. The controller is configured to receive the signal from the actuator and adjust a pressure of at least one of the plurality of chambers in the carrier head based on the signal.

Advantages of implementations can include one or more of the following. The thickness of the retaining ring may be measured reliably before a polishing operation and without loss of throughput. The measured thickness may be used to adjust polishing parameters, particularly a pressure applied by the carrier head, and WTWNU may be improved.

DETAILED DESCRIPTION

Figure 1:
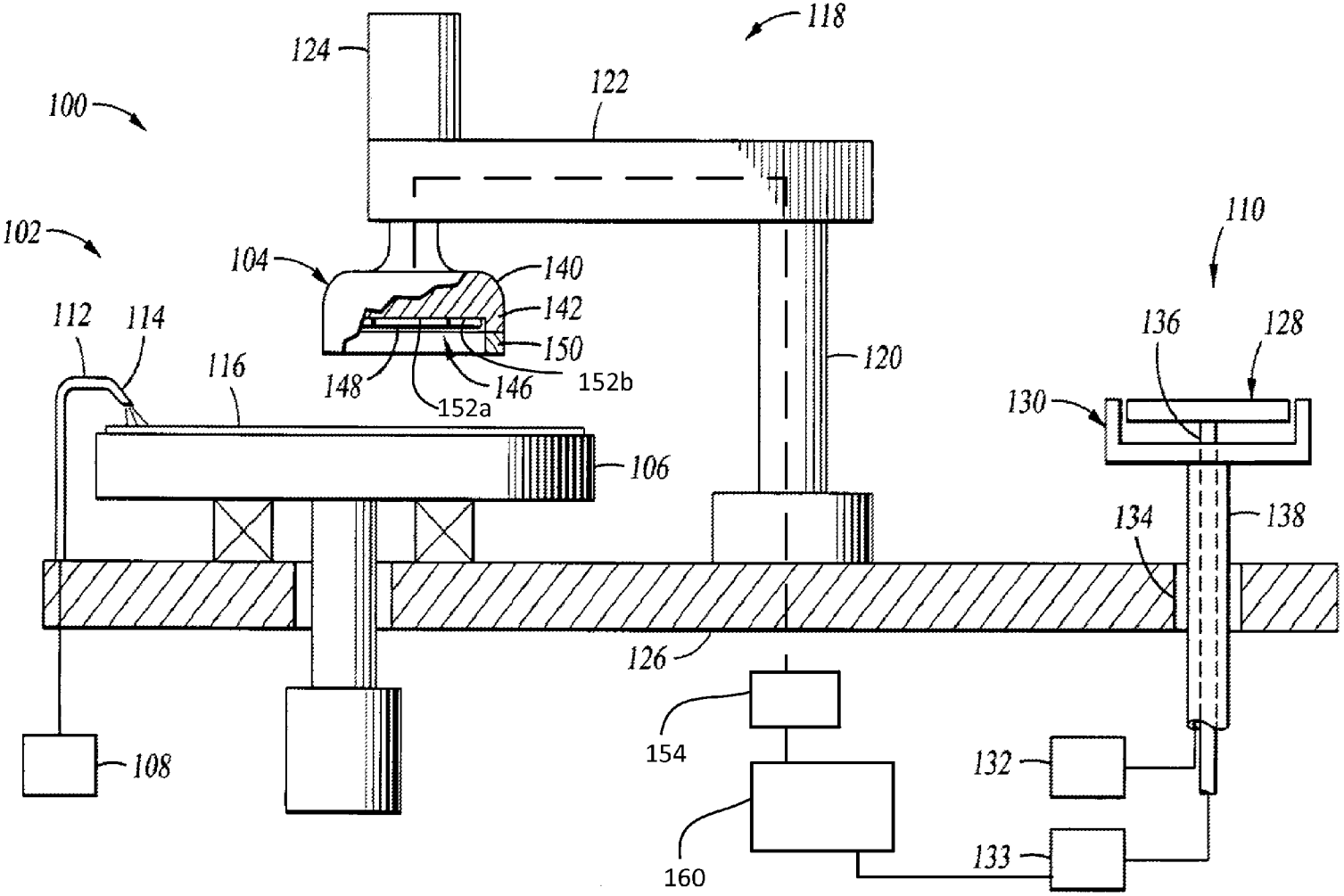
FIG. 1 is a simplified side view, partially in section, of an implementation of a chemical mechanical polishing system.

FIG. 1 depicts a partially sectional view of a simplified chemical mechanical polishing system 100 that includes a polishing station 102, a carrier head 104 and a load cup 110. Although the load cup 110 is shown in one implementation of a polishing system 100, the load cup 110 may be utilized in other processing system that utilizes a substrate-retaining head to retain a substrate in a face down orientation during processing. Examples of suitable polishing systems which may be adapted to benefit from the invention include MIRRA™ and REFLEXION™ chemical mechanical polishing systems available from Applied Materials. Other polishing systems that may be adapted to benefit from the invention include systems described in U.S. Pat. No. 5,738,574, which is hereby incorporated by reference in its entirety.

In one implementation, the polishing station 102 includes a rotatable platen 106 having a polishing material 116 disposed thereon. The polishing material 116 may be a conventional polyurethane polishing pad, a fixed abrasive material, or another pad suitable for chemical mechanical polishing.

The polishing station 102 additionally includes a fluid source 108 adapted to provide a polishing fluid to the working surface of the polishing material 116 during processing. In the embodiment depicted in FIG. 1, an arm 112 having at least one nozzle 114 is positioned to flow polishing fluid onto the polishing material 116 during processing.

The carrier head 104 is generally supported above the polishing station 102 by a transfer mechanism 118 coupled to a base 126. The transfer mechanism 118 is generally adapted to position the carrier head 104 selectively between a processing position over the polishing material 116 and a transfer position over the load cup 110. In the implementation depicted in FIG. 1, the transfer mechanism 118 includes a stanchion 120 having a cantilevered arm 122 that may be rotated to laterally position the carrier head 104. The carrier head 104 can be coupled to the arm 122 by a drive mechanism 124. The drive mechanism 124 can be adapted to impart rotation to the carrier head 104. The elevation of the polishing head 104 relative to the base 126 can be controlled by the drive mechanism 124 or by a pressurizable chamber inside the carrier head 104. A suitable carrier head is described in U.S. Pat. No. 7,699,688, which is hereby incorporated by reference in its entirety.

Generally, the polishing head 104 comprises a housing 140 and a retaining ring 150 secured near an edge of the housing, e.g., to a rim 142, to further retaining the substrate within a recess 146 in the polishing head 104 during polishing.

In some implementations, the carrier head 104 includes a flexible membrane 148, behind which are a plurality of independently pressurizable chambers, which can apply different pressures to different radial zones of the substrate. For example, the carrier head can include a first chamber 152*a* to apply pressure to a central portion of the substrate and a second chamber 152*b* to apply pressure to an edge portion of the substrate. The chambers 152*a*, 152*b* are coupled to pressure sources 154 (only one is shown in FIG. 1 for simplicity) such that the chambers 152*a*, 152*b* can be independently controllably inflated or deflated.

In order to perform a transfer operation, the flexible membrane 148 can be brought in contact with the substrate, and one or more the chambers 152*a*, 152*b* can be deflated, thus creating a vacuum between the substrate and the flexible membrane and thereby securing the substrate on the carrier head 104. In order to perform a polishing operation, one or more the chambers 152*a*, 152*b* can be inflated, thus pressing the substrate against the polishing pad 115.

The vertical position of the retaining ring 150, and the pressure of the retaining ring 150 against the polishing pad 116, can also be adjustable, e.g., by the drive mechanism 124 or by another pressurizable chamber inside the carrier head 104. Pressure in the pressurizable chamber inside the carrier head 104 that controls the vertical position of the retaining ring 150 can be controlled by the pressure source 154.

The load cup 110 generally includes a pedestal assembly 128 and a cup 130. The pedestal assembly 128 is supported by a shaft 136. The cup 130 is supported by a shaft 138. The shafts 136, 138 extend through a hole 134 in the base 126 and are respectively coupled to actuators 133, 132 that respectively control the elevation of the pedestal assembly 128 and the cup 130 relative to the base 126. The pedestal assembly 128 provides a structure that mates with the polishing head 104 to insure alignment therebetween during substrate transfer. The pedestal assembly 128 is generally extended to transfer the substrate to the polishing head 104 and retracts from the extended position to receive the substrate during the process of de-chucking, as further described below.

A controller 160, e.g., a programmed computer including a microprocessor, is coupled to the actuators 132, 133 to control the actuators 132, 133 in accord with a processing procedure, and to receive signals at least from the actuator 133 indicating the vertical extension of the pedestal assembly 128. The controller 160 can also be coupled to the pressure source 154 or to the drive mechanism 124, to control the vertical extension of the retaining ring 150 and/or the pressures in the chambers 152*a*, 152*b* in the carrier head.

Figure 2:
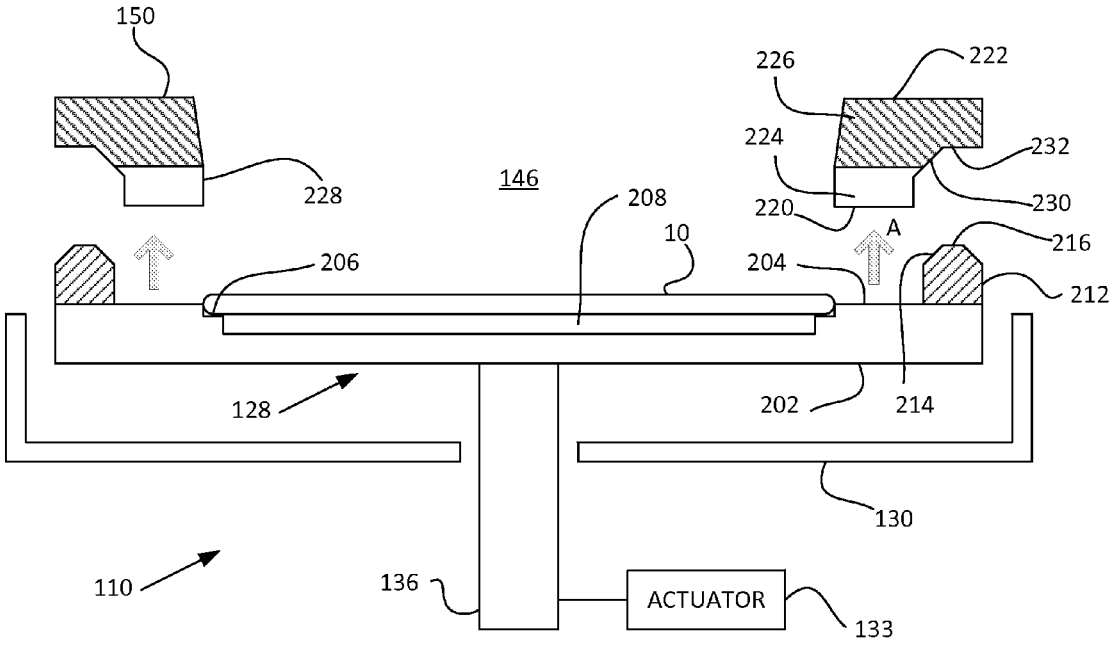
FIG. 2 is a sectional view of one embodiment of a load cup and a retaining ring. To facilitate understanding, identical reference numerals have been used, wherever possible, to designate identical elements that are common to the figures.

FIG. 2 depicts a sectional view of one implementation of the pedestal assembly 128 and the retaining ring 150 of the carrier head 104 (the remainder of the carrier head 104 is not illustrated for simplicity). The pedestal assembly 128 includes at least an upper pedestal 202. In some implementations, the upper pedestal is coupled to a lower pedestal, and is generally configured to move both angularly and laterally with respect to the lower pedestal. This permits the upper pedestal 202 to shift so as to permit alignment of the substrate with the pocket 146 inside the retaining ring 150. The upper pedestal 202 also includes a ledge 206, e.g., an annular ledge, surrounding a recessed area 208. The ledge 206 supports an edge of a substrate 10 in an exclusion zone of the substrate 10. The exclusion zone of the substrate is an outer perimeter of the feature side of the substrate, e.g., an outer 2 millimeters, that has no features formed on it.

The pedestal assembly can also include other features, such as gripper assemblies to mechanically retain the substrate within the load cup, rinsing nozzles to spray a cleaning fluid on the substrate and/or retaining ring, and/or a sensor adapted to detect the presence of the substrate in the load cup 110.

The retaining ring 150 has a bottom surface 220 that will be brought into contact with the polishing pad 116 (see FIG. 1). An inner diameter surface 228 of the retaining ring 150 is used to retain the substrate during the polishing operation. As noted above, the retaining ring is typically formed of a wearable material, e.g., a plastic, and as polishing progresses, the bottom surface 220 of the retaining ring is worn away. Thus, the total height between the bottom surface 220 and the top surface 222 of the retaining ring will vary from substrate to substrate. In some implementations, the retaining ring 150 includes a lower portion 224 of the wearable material and an upper portion 226 of a material, e.g., a metal, that is harder than the lower portion 224. In other implementations, the entire retaining ring 150 is a plastic.

An outer diameter surface of the retaining ring 150 can include an alignment feature to mate with a corresponding feature on the pedestal assembly 128. This permits the carrier ring and the pedestal to align so that the substrate 10 is aligned with the pocket 146 inside the retaining ring 150. The alignment feature can include a slanted region 230 of the outer diameter that is sloped inwardly from the top toward the bottom of the retaining ring. The retaining ring 150 can also include a flange portion that has a generally horizontal lower surface 232 located radially outward of the slanted region 230.

In some implementations, a raised lip 212 protrudes axially along the outer edge of the upper pedestal 202. The lip 212 includes a sloped inner wall 214 configured to mate with the slanted portion 230 of the outer diameter surface of the retaining ring 150. The sloped inner wall 214 and the slanted region 230 can have the same angle of inclination, e.g., 45°. The lip 212 can also include a horizontal top surface 216.

As the actuator 133 causes the pedestal 128 to lift upwardly (arrow A), the sloped inner wall 214 engages the sloped portion 230, causing the upper pedestal 202 and/or the retaining ring 150 to shift laterally to align the substrate 10 with the pocket 146 inside the retaining ring 150.

As the actuator 133 continues to lift the pedestal 128 upwardly, a top surface 204 of the upper pedestal 202 abuts the bottom surface 220 of the retaining ring 150. Alternatively, if the retaining ring is sufficiently thin, then as the actuator 133 continues to lift the pedestal 128 upwardly, the top surface 216 of the lip 212 abuts the lower surface 232 of the flange of the retaining ring 150. Thus, the flange acts as a hard stop on the motion of the pedestal 128.

The load cup 110 can be used to measure the thickness or amount of wear of the retaining ring. In particular, the actuator 133 can generate a signal representing the vertical height of the pedestal. For example, the signal can be a voltage level generated by the actuator to raise the pedestal to a given position. As noted above, during the loading procedure, the actuator 133 lifts the pedestal 128 upwardly until a top surface 204 of the upper pedestal 202 abuts the bottom surface 220 of the retaining ring 150. If the retaining ring is thicker, then the pedestal 128 will not be raised as high before contacting the retaining ring 150. On the other hand, as the retaining ring wears and becomes thinner, the pedestal 128 will need to be raised higher before contacting the bottom surface 220 of the retaining ring 150. Consequently, the signal from the actuator 133, measured or generated when the pedestal 128 abuts the bottom surface 220 of the retaining ring 150, can correlates to the thickness of the retaining ring. In some implementations, a separate sensor, e.g., a linear encoder or an optical distance sensor, detects the distance traveled by the pedestal or the position of the pedestal 128 when it abuts the bottom surface 220 of the retaining ring 150. The load cup 110 can be used to measure the thickness or amount of wear of the retaining ring 150. Moreover, the measurement of the retaining ring thickness can be performed during the regular substrate loading or unloading procedure, without removing the retaining ring or affecting substrate throughput.

In some implementations, the thickness of the retaining ring can be measured empirically for multiple signal values, and a look-up-table can be generated to convert the value of the signal into a thickness measurement. In some implementation, the "raw" signal from the actuator 133, e.g., a voltage value, can be used as a thickness signal.

In some implementations, the controller 160 is configured to determine the amount of wear of, i.e., the thickness removed from, the retaining ring 150. For example, the controller can store the thickness signal value generated for a "fresh" retaining ring 150. Thereafter, as the retaining ring 150 is worn, later thickness signals value can be subtracted from the stored thickness signal value to generate a difference value. This difference value represents the thickness removed from the retaining ring 150.

The "raw" signal, the thickness measurement, and the amount of wear are all considered a retaining ring thickness signal.

In some implementations, the controller 160 can compare the thickness signal to a threshold value. In the case of the raw signal or thickness measurement, if the thickness signal falls below the threshold value (or exceeds the threshold value in the case of the difference signal), then the controller 160 can generate a signal, e.g., a visual or audible signal to the operator, that the retaining ring needs to be replaced. This permits the retaining ring to be replaced when the retaining ring has been worn to a predetermined thickness, rather than after a predetermined number of polishing operations, which can permit the retaining ring to be used until closer to its maximum lifetime.

In some implementations, the controller 160 uses the thickness signal to determine an adjustment to one or more pressures applied by the carrier head 104. For example, the vertical position of the retaining ring 150 can be adjusted, e.g., by setting an appropriate pressure from the pressure source 154, so that the polishing pad is compressed by a more uniform amount from substrate-to-substrate as the retaining ring wears. Alternatively or in addition, the pressure in one or more of the chambers 152*a*, 152*b* can be adjusted to compensate for changes in polishing rate at the edge of the substrate induced by the change in the retaining ring thickness. In some implementations, the controller 160 stores a table that relates different thickness signal values to different correction factors. The correction factor can be additive or multiplicative. By applying the correction factor to the pressures applied by the carrier head, within-wafer non-uniformity (WIWNU) and wafer-to-wafer non-uniformity (WTWNU) can be reduced over the lifetime of the retaining ring.

The present invention has been described in terms of a number of embodiments. The invention, however, is not limited to the embodiments depicted and described. Rather, the scope of the invention is defined by the appended claims.

The invention claimed is:

1. A load cup apparatus for transferring a substrate in a processing system, comprising:

a pedestal assembly having a substrate support configured to support a rim of the substrate, the pedestal assembly further comprising a top surface and a lip projecting upward from the top surface and configured to surround a retaining ring of a carrier head to receive the substrate, the top surface and the lip fixed to substrate support such that the top surface and the lip travel vertically with the substrate support;

an actuator configured to move the pedestal assembly with the substrate support, top surface and lip moving together into a loading or unloading position such that the top surface of the pedestal assembly is in contact with a bottom surface of the retaining ring of the carrier head, the actuator configured to generate a retaining ring thickness signal based on a distance traveled by the pedestal assembly for the top surface of the pedestal assembly to contact the retaining ring while the substrate support remains vertically fixed relative to the top surface; and a controller configured to receive the retaining ring thickness signal from the actuator.

2. The apparatus of claim 1, wherein the pedestal assembly comprises a body having the top surface and an inwardly projecting ledge to support the substrate, the ledge having an upper surface below the top surface.

3. The apparatus of claim 2, the lip has a sloped inner wall.

4. The apparatus of claim 3, wherein the lip has a horizontal surface radially outward of the sloped inner wall.

5. The apparatus of claim 1, wherein the controller is configured to compare the retaining ring thickness signal to a threshold value and to determine whether to generate an alarm based on the comparison.

6. The apparatus of claim 1, wherein the controller is configured to adjust a pressure of at least one chamber in the carrier head based on the retaining ring thickness signal.

7. The apparatus of claim 6, wherein the controller is configure to determine a retaining ring thickness value from the retaining ring thickness signal.

8. The apparatus of claim 7, wherein the controller is configured to store a look-up table relating signal values to thickness values.

9. The apparatus of claim 6, wherein the at least one chamber comprises a chamber that adjusts a vertical position of the retaining ring.

10. The apparatus of claim 1, wherein the retaining ring thickness signal comprises a voltage of the actuator.

11. The apparatus of claim 1, wherein the controller is configured to receive the retaining ring thickness signal during loading of the substrate into the carrier head.

12. The apparatus of claim 1, wherein the controller is configured to receive the retaining ring thickness signal during unloading of the substrate from the carrier head.

13. A load cup apparatus for transferring a substrate in a processing system, comprising:

a pedestal assembly having a substrate support configured to support a rim of the substrate, the pedestal assembly further comprising a top surface and a lip projecting upward from the top surface and configured to surround a retaining ring of a carrier head to receive the substrate, the top surface and the lip fixed to substrate support such that the top surface and the lip travel vertically with the substrate support;

an actuator configured to move the pedestal assembly with the substrate support, top surface and lip moving together into a position such that the top surface of the pedestal assembly is in contact with a bottom surface of the retaining ring of the carrier head;

a sensor to determine a distance traveled by the pedestal assembly for the top surface of the pedestal assembly to contact the retaining ring while the substrate support remains vertically fixed relative to the top surface; and a controller configured to receive a signal from the sensor and determine a thickness of the retaining ring based on the signal from the sensor.

14. The apparatus of claim 13, wherein the signal comprises a voltage of the actuator.

15. The apparatus of claim 13, wherein the controller is configured to receive the retaining ring thickness signal during loading of the substrate into the carrier head.

16. The apparatus of claim 13, wherein the controller is configured to adjust a pressure of at least one chamber in the carrier head based on the retaining ring thickness signal.

17. A polishing apparatus, comprising:

a polishing station;

a transfer station including a pedestal assembly and an actuator, the pedestal assembly having a substrate support configured to support a rim of a substrate, the pedestal assembly further having a top surface and a lip projecting upward from the top surface, the top surface and the lip fixed to substrate support such that the top surface and the lip travel vertically with the substrate support, the actuator configured to move the pedestal assembly with the substrate support, top surface and lip moving together into a loading or unloading position, the actuator configured to generate a signal based on a distance traveled by the pedestal assembly;

a carrier head movable between the polishing station and the transfer station, the carrier head including a retaining ring and a plurality of independently pressurizable chambers, wherein the lip is configured to surround a retaining ring of a carrier head, and wherein in the loading or unloading position the top surface of the pedestal assembly contacts a bottom surface of the retaining ring; and a controller configured to receive the signal from the actuator based on a distance traveled by the pedestal assembly for the top surface of the pedestal assembly to contact the retaining ring while the substrate support remains vertically fixed relative to the top surface, and adjust a pressure of at least one of the plurality of chambers in the carrier head based on the signal.

18. A method of operating a polishing apparatus, comprising:

loading a substrate from a pedestal assembly to a carrier head, the pedestal assembly having a substrate support configured to support a rim of the substrate, the pedestal assembly further comprising a top surface and a lip projecting upward from the top surface and configured to surround a retaining ring of a carrier head to receive the substrate, the top surface and the lip fixed to substrate support such that the top surface and the lip travel vertically with the substrate support;

polishing the substrate; and unloading the substrate from the carrier head to the pedestal assembly;

wherein at least one of loading or unloading includes raising the pedestal assembly with the substrate support, top surface and lip moving together to a position at which the top surface of the pedestal assembly contacts a bottom surface of the retaining ring of the carrier head, generating a retaining ring thickness signal based on a distance traveled by the pedestal assembly for the top surface of the pedestal assembly to contact the retaining ring while the substrate support remains vertically fixed relative to the top surface, and adjusting a pressure of at least one of the plurality of chambers in the carrier head based on the signal.

* * * * *